US008973389B2

(12) United States Patent
Lee et al.

(10) Patent No.: US 8,973,389 B2
(45) Date of Patent: Mar. 10, 2015

(54) MOBILE COOLER WITH ICE MAKER

(75) Inventors: Namgi Lee, Seoul (KR); Sungil Park, Seoul (KR); Sangoh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 102 days.

(21) Appl. No.: 13/395,782

(22) PCT Filed: Aug. 12, 2010

(86) PCT No.: PCT/KR2010/005303

§ 371 (c)(1),
(2), (4) Date: Mar. 13, 2012

(87) PCT Pub. No.: WO2011/031012

PCT Pub. Date: Mar. 17, 2011

(65) Prior Publication Data

US 2012/0167612 A1 Jul. 5, 2012

(30) Foreign Application Priority Data

Sep. 14, 2009 (KR) ..... 10-2009-0086622

(51) Int. Cl.

| | |
|---|---|
| ***F25C 1/24*** | (2006.01) |
| ***F25D 25/02*** | (2006.01) |
| ***A47B 51/00*** | (2006.01) |
| ***F25D 25/04*** | (2006.01) |
| ***F25C 5/18*** | (2006.01) |
| ***F25D 11/00*** | (2006.01) |

(52) U.S. Cl.

CPC ..... *F25C 5/185* (2013.01); *F25D 11/00* (2013.01); *F25D 2400/12* (2013.01)

USPC ..... 62/259.1; 62/258; 62/320; 62/440; 62/344; 62/157; 62/371; 62/340; 62/115; 62/441; 62/407; 312/408; 312/306; 312/312

(58) Field of Classification Search

CPC ... F25D 25/02; F25D 25/04; F25D 2325/022; F25D 2325/023; F25D 2500/02; F25D 25/024; F25D 2400/10; F25D 17/065; A47B 51/00; A47B 2220/0013

USPC ..... 62/326, 371, 344, 347, 351, 157, 441, 62/447, 457.9, 459, 327; 414/267; 312/319.5, 404

See application file for complete search history.

(56) References Cited

U.S. PATENT DOCUMENTS 5,904,054 A * 5/1999 Lee ..... 62/347
7,306,303 B2 * 12/2007 Ritchie et al. ..... 312/408

(Continued)

FOREIGN PATENT DOCUMENTS

EP 0 745 816 A1 12/1996
JP 50-55663 A 5/1975

(Continued)

*Primary Examiner* — Frantz Jules
*Assistant Examiner* — Meraj A Shaikh
(74) *Attorney, Agent, or Firm* — Birch, Stewart, Kolasch & Birch, LLP

(57) ABSTRACT

A mobile cooler having an ice maker includes: a main body having first and second spaces which are thermally blocked; a cooling device positioned at a lower portion of the main body and providing cooling air to the first and second spaces; a plurality of shelves installed in the first space; an ice tray installed in the second space; an ice bank positioned on a lower surface of the ice tray and detachably mounted in the main body; and a cover that covers an opening in which the ice bank is inserted.

8 Claims, 2 Drawing Sheets

(56) References Cited

U.S. PATENT DOCUMENTS

| | | | | |
|---|---|---|---|---|
| 7,448,226 | B2 * | 11/2008 | Yamashita et al. | 62/259.2 |
| 7,921,666 | B2 * | 4/2011 | Lee | 62/320 |
| 8,074,468 | B2 * | 12/2011 | Yoo et al. | 62/440 |
| 2004/0177638 | A1 * | 9/2004 | Onishi et al. | 62/351 |
| 2006/0042301 | A1 * | 3/2006 | Oh et al. | 62/407 |
| 2006/0137375 | A1 * | 6/2006 | Lishman | 62/258 |
| 2006/0242988 | A1 * | 11/2006 | Kim et al. | 62/441 |
| 2006/0266070 | A1 * | 11/2006 | Ertz et al. | 62/441 |
| 2008/0104977 | A1 * | 5/2008 | Coulter et al. | 62/132 |
| 2008/0295539 | A1 | 12/2008 | An et al. | |
| 2009/0003981 | A1 * | 1/2009 | Miller | 414/267 |
| 2010/0050681 | A1 * | 3/2010 | Ryu et al. | 62/344 |
| 2010/0170275 | A1 * | 7/2010 | Konrad et al. | 62/259.1 |
| 2011/0041542 | A1 * | 2/2011 | Brunner et al. | 62/344 |

FOREIGN PATENT DOCUMENTS

| | | | | |
|---|---|---|---|---|
| JP | 2007120822 | A | * | 5/2007 |
| KR | 20-1990-0012745 | U | | 7/1990 |

* cited by examiner

MOBILE COOLER WITH ICE MAKER

TECHNICAL FIELD

The present invention relates to a mobile cooler having an ice maker and, more particularly, to a compact mobile cooler.

BACKGROUND ART

A mobile cooler is used to assist the generally used home refrigerators. The mobile cooler is small compared with a mount-type cooler and includes units such as carriers or wheels for moving. Unlike the general fixed type refrigerator, the mobile cooler can be used while changing areas, so it is commonly used in outdoor activities such as travel or leisure activity, and can be also used as a dedicated refrigerator for keeping particular articles or items in storage even in households.

The mobile cooler, cooling stored items in various manners, can be divided into a cooler type that provides cooling during a certain time period by introducing a cooling preservationer such as ice or an ice pack in the interior of the cooler an a cooler type that provides cooling by operating an installed freezing system upon receiving power from a battery or an external power source.

Among them, the mobile cooler having the freezing system includes a main body having a storage space therein and a cooling device installed within the main body. A shelf for putting cooling items thereon is mounted within the storage space, and a door for opening and closing the storage space is installed in the main body.

However, the mobile cooler having such a structure as described above merely provides a simple cooling function, so its use is limited.

DISCLOSURE OF INVENTION

Technical Problem

Therefore, in order to address the above matters, the various features described herein have been conceived.

An aspect of the present invention provides a mobile cooler having an ice making function as well as a cooling function.

Solution to Problem

According to an aspect of the present invention, there is provided a mobile cooler including: a main body having first and second spaces which are thermally blocked; a cooling device positioned at a lower portion of the main body and providing cooling air to the first and second spaces; a plurality of shelves installed in the first space; an ice tray installed in the second space; an ice bank positioned on a lower surface of the ice tray and detachably mounted in the main body; and a cover that covers an opening in which the ice bank is inserted.

In the above aspect of the present invention, an internal space provided in the interior of the main body is divided into two mutually insulated spaces, and an ice maker is installed in one of the two spaces. The ice maker includes the ice tray and the ice bank for keeping ice cubes which have been made in storage. Here, water can be supplied to the ice try by the user, or by using a water supply device.

The second space may be positioned at a lower portion of the first space. In this case, the shelf may be drawn in an upward direction of the main body. A cap for opening and shutting the internal space of the main body may be included at an upper portion of the shelf, and the cap and the shelf may be connected to be moved together.

Here, the mobile cooler may further include: a driving unit for lifting and lowering the shelf in a vertical direction of the main body. As the driving unit, an electric motor and a power transmission unit that converts a rotational movement of the electric motor into an ascending and descending movement of the shelf may be used.

The mobile cooler may further include: a third space thermally blocked with the first and second spaces; and a water supply unit installed in the third space for supplying water to the ice tray. Here, the water supply unit may include: a water supply tank storing water to be supplied to the ice tray and detachably mounted within the third space; a pump supplying water stored in the water supply tank to the ice tray; and a water supply pipe having one end connected with the pump and the other end positioned at an upper portion of the ice tray.

The water supply tank may be positioned at the opposite side of the ice bank based on the main body.

The mobile cooler may further include: an ice discharge unit for discharging ice within the ice tray to the ice bank. The ice discharge unit may discharge ice by rotationally twisting the ice tray or ice may be separated from the ice tray through a heating unit.

The ice bank may be connected with the cover so as to be moved together.

The mobile cooler may further include: an isolation wall demarcating the second and third spaces, and the pump may be installed at an inner side of the isolation wall.

Advantageous Effects of Invention

According to exemplary embodiments of the present invention, because the mobile cooler has the ice making function in addition to the function of cooling stored items, the mobile cooler can be used for various purposes.

The foregoing and other objects, features, aspects and advantages of the present invention will become more apparent from the following detailed description of the present invention when taken in conjunction with the accompanying drawings.

BEST MODE FOR CARRYING OUT THE INVENTION

A mobile cooler according exemplary embodiments of the present invention will now be described in detail with reference to the accompanying drawings.

Figure 1:
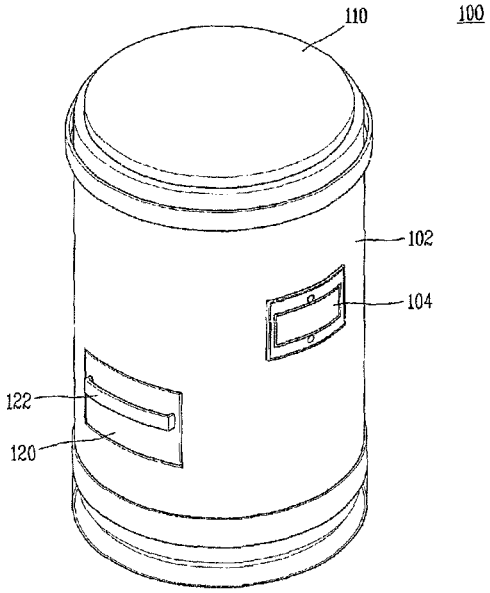
FIG. 1 is a perspective view of a mobile cooler having an ice maker according to an exemplary embodiment of the present invention.

FIG. 1 is a perspective view of a mobile cooler having an ice maker according to an exemplary embodiment of the present invention. With reference to FIG. 1, the mobile cooler 100 includes a main body 102 having a cylindrical shape as a whole and a cap 110 having a disk-like shape and positioned at an upper portion of the main body 102. Although not shown, wheels (not shown) for allowing the mobile cooler to move are mounted on a lower surface of the main body 102, and a display window 104 for displaying an operational state of the mobile cooler is provided on the side of the main body 102. A manipulation button for manipulating the main body 102 may be provided to the display window 104.

An ice bank cover 120 is installed to be adjacent to the display window 104. An ice bank (to be described) is mounted at an inner side of the ice bank cover 120. A handle 122 is installed on the surface of the ice bank cover 120 to facilitate drawing out the ice bank. A water tank cover (to be described) is positioned at the opposite side of the ice bank cover 120.

Figure 2:
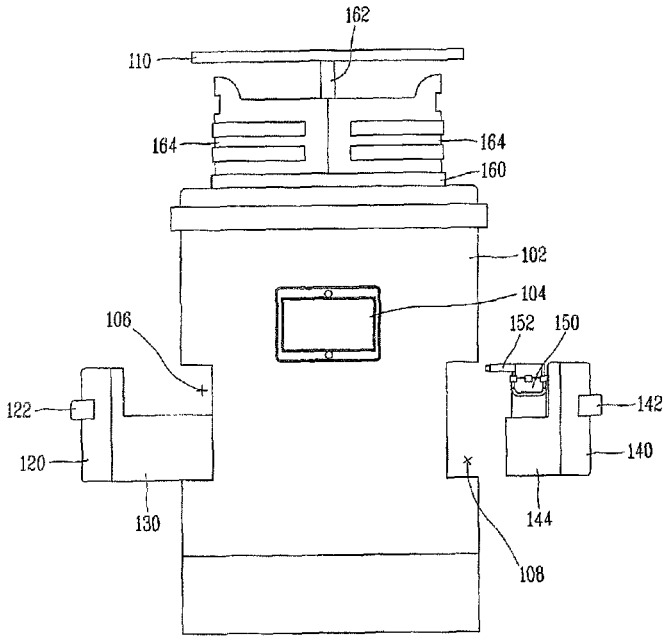
FIG. 2 is a side view showing the mobile cooler with a cover open in FIG. 1 according to an exemplary embodiment of the present invention.

FIG. 2 is a side view showing a state in which the cap 110 is open in the mobile cooler with a cover open in FIG. 1 according to an exemplary embodiment of the present invention. In FIG. 2, it is illustrated that the ice bank and the water tank are drawn out of the main body 102.

The ice bank 130, a container for keeping ice (e.g., ice cubes) produced by the ice tray (to be described) in storage, is detachably mounted at an inner side of the main body 102 through an opening 106. A tank cover 140 is mounted in an opening 108 formed on the side surface of the main body 102 at the opposite side of the ice bank 130. A handle 142 is formed on an outer surface of the water tank cover 140. A water tank support 144 is formed at an inner side of the water tank cover 140.

The water tank support 144 has a pocket form in which a lower portion of the water tank 150 is insertedly fixed, and accordingly, the water tank 150 can be freely attached and detached. The water tank 150 includes a storage space for keeping water to be used for ice making in storage at an inner side thereof, and a water supply hole is formed at an upper portion thereof. The water supply hole is opened and shut by a cap (to be described). A first water supply pipe 152 is installed to be protruded from the side of an upper portion of the water tank 150.

The first water supply pipe 152 is connected with a pump (to be described) to allow water kept within the water tank 150 to be transferred to the ice tray. The first water supply pipe 152 extends to a lower surface of the water tank 150.

The cap 110 is open in an upward direction of the main body 102. In detail, a lifting plate 160 is positioned at a lower side of the cap 110, and a fixed shaft 162 is installed between the lifting plate 160 and the cap 110. A driving shaft (to be described) is insertedly positioned within the fixed shaft 162, and the driving shaft is threaded with the lifting plate 160 by using a ball screw. Accordingly, when the driving shaft rotates, the lifting plate 160 ascends or descends along the main body 102, and accordingly, the cap 110 also ascends or descends together. The operational structure of the lifting plate 160 will be described later.

Two baskets 164 are mounted on an upper surface of the lifting plate 160. Each basket 164 has a section in a semicircular shape and is mounted to be slidable along an outer direction of the main body 102.

Figure 3:
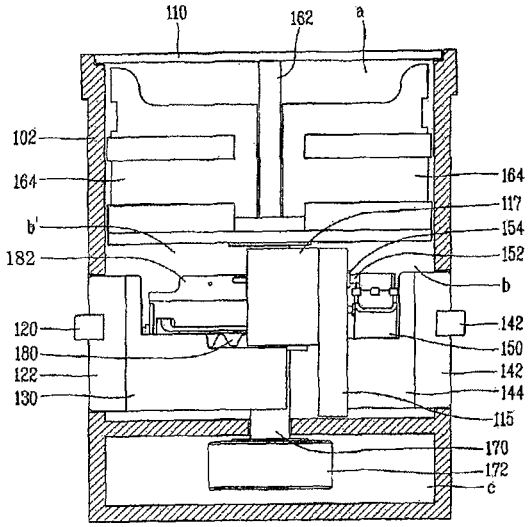
FIG. 3 is a partially cut view showing an internal structure of the mobile cooler of FIG. 1 according to an exemplary embodiment of the present invention.

FIG. 3 is a partially cut view showing an internal structure of the main body 102. With reference to FIG. 3, it is noted that the internal space of the main body 102 is blocked into a total of four spaces. A space 'a' positioned at the uppermost portion serves as a refrigerating chamber suitable for keeping beverage or the like in storage as described above, a space 'b' positioned at a lower side of the space 'a' is for receiving the water tank, a space 'b'' positioned to be adjacent to the space 'b' serves as an ice making chamber, and a space 'c' serves as a mechanic chamber in which a cooling air supply device such as a compressor or the like is accommodated.

Here, the respective spaces are thermally blocked. In other words, the spaces are blocked to be insulated with each other, for which an isolation wall 115 is positioned between the spaces 'b' and 'b''. The isolation wall 115 is made of an insulation material for preventing water stored within the water tank from being frozen, or may include an insulator therein. A pump receiving unit 117 is formed at an upper portion such that it is protruded toward the space 'b''. A pump is accommodated within the pump receiving unit 117 so that the interior of the pump cannot be frozen.

A coupler 154 is installed at the opposite side of the pump receiving unit 117. The coupler 154 connects the first water supply pipe 152 and the pump. When the water tank cover 140 is pushed in, it can be inserted into the interior of the coupler 154 of the first water supply pipe 152.

An ice tray installation part 182 is positioned in the space 'b'', and an ice tray 180 for making ice is rotatably installed in the ice tray installation part 182. Both end portions of the ice tray 180 are rotatably fixed at the ice tray installation part 182, and in this case, a stopper is positioned at a left end portion in FIG. 3 to limit the rotation angle of the ice tray 180. Thus, when a right end portion of the ice tray 180 is rotated, the ice tray 180 is twisted, and accordingly, ice which has been made is discharged to be stored within the ice bank 130.

An example in which the ice tray 180 is made of a metal material and an ice discharge unit having a heating unit for heating the ice tray may be considered.

A driving motor 172 is installed in the space 'c' and a driving shaft 170 is installed at a rotary shaft of the driving motor 172. As mentioned above, the driving shaft 170 is threaded with the lifting plate 160 through a ball screw. Thus, when the driving motor 172 rotates, the driving shaft 170 is rotated, and the lifting plate 160 ascends or descends along the rotational direction. A manipulation button for controlling the rotation of the driving motor 172 may be provided at the display window 104.

Figure 4:
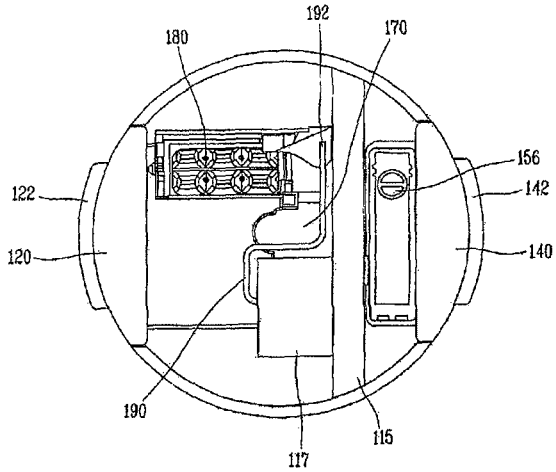
FIG. 4 is a plan view showing an ice maker part of the mobile cooler of FIG. 1 according to an exemplary embodiment of the present invention.

FIG. 4 is a plan view of the spaces 'b' and 'b''. With reference to FIG. 4, it is noted that a second water supply pipe 190 is installed at the side of the pump receiving unit 117. The second water supply pipe 190 is connected with an output side of the pump, and the other end portion thereof extends up to an upper portion of a water supply guide 192 positioned at an upper portion of the ice tray 180. Accordingly, water in the interior of the water tank sucked through the pump is introduced to the water supply guide 192 through the second water supply pipe 190, and then supplied to the ice tray 180.

The foregoing driving shaft 170 is positioned in the space between the water supply guide 192 and the pump receiving unit 117.

Figure 5:
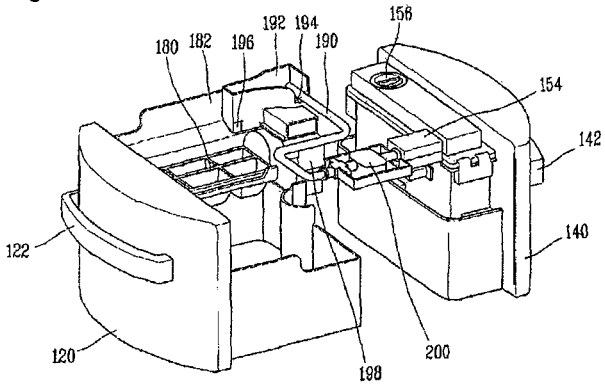
FIG. 5 is a perspective view showing an internal structure of the mobile cooler of FIG. 1 according to an exemplary embodiment of the present invention.

FIG. 5 is a perspective view of a water supply unit positioned between the water tank and the ice tray. With reference to FIG. 5, a cutout portion 194 is positioned at one side of the water supply guide 192 to allow the second water supply pipe 190 to pass therethrough, and a water supply hole 196 is positioned at an upper side of the ice tray 180. Accordingly, water supplied through the second water supply pipe 190 is temporarily stored in the water supply guide 192 and then supplied to the ice tray through the water supply hole 196. Namely, the water supply guide 192 serves as a buffer for controlling a water supply quantity by temporarily storing water supplied through the pump 20 as well as forming a water supply flow path.

As mentioned above, the pump 200 is positioned between the coupler 154 and the second water supply pipe 194 and includes a flow quantity measurement unit (not shown) in order to supply a fixed quantity. In this case, the fixed quantity is previously determined in consideration of the capacity of the ice tray, and when it is detected that the fixed quantity of water has been supplied by the flow quantity measurement unit, the operation of the pump is stopped to prevent water from being introduced into the ice bank.

Meanwhile, an ice discharge unit is installed at an inner side of one end portion 198 of the ice tray 180. The ice discharge unit includes a driving motor for transmitting a rotational driving force to the ice tray and a deceleration gear, by which the ice tray can be twisted to discharge ice.

In the exemplary embodiment as described above, the water supply unit and the ice discharge unit are provided, but the present invention is not necessarily limited thereto and the water supply unit may be omitted and the user may directly supply water. In this case, the water tank, the isolation wall, or the like, may be omitted. Also, the ice discharge unit may be also omitted. Namely, the driving motor and the deceleration gear may be omitted and a lever may be instead installed, so that when the user pulls the lever, the ice tray may be rotated to be twisted.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A mobile cooler comprising:

a main body having first and second spaces which are thermally blocked;

a cooling device positioned at a lower portion of the main body and providing cooling air to the first and second spaces;

a plurality of shelves installed in the first space;

a cap positioned at an upper portion of the shelves;

a driving unit for lifting and lowering the shelves in a vertical direction of the main body based on a rotational movement of the driving unit;

an ice tray installed in the second space;

an ice bank positioned on a lower surface of the ice tray and detachably mounted in the main body; and a cover that covers an opening in which the ice bank is inserted, wherein the cap and the shelves are connected to be moved together so that the cap opens an internal space of the main body and the shelves are drawn in the vertical direction of the main body based on the rotational movement of the driving unit.

2. The mobile cooler of claim 1, wherein the second space is positioned at a lower portion of the first space.

3. The mobile cooler of claim 1, further comprising:

a third space thermally blocked with the first and second spaces; and a water supply unit installed in the third space for supplying water to the ice tray.

4. The mobile cooler of claim 3, wherein the water supply unit comprises:

a water supply tank storing water to be supplied to the ice tray and detachably mounted within the third space;

a pump supplying water stored in the water supply tank to the ice tray; and a water supply pipe having one end connected with the pump and the other end positioned at an upper portion of the ice tray.

5. The mobile cooler of claim 4, wherein the water supply tank is positioned at the opposite side of the ice bank based on the main body.

6. The mobile cooler of claim 4, further comprising:

an ice discharge unit for discharging ice within the ice tray to the ice bank.

7. The mobile cooler of claim 6, wherein the ice bank is connected with the cover so as to be moved together.

8. The mobile cooler of claim 4, further comprising:

an isolation wall demarcating the second and third spaces, wherein the pump is installed at an inner side of the isolation wall.

* * * * *